US010301146B2

(12) United States Patent
Porter

(10) Patent No.: US 10,301,146 B2
(45) Date of Patent: May 28, 2019

(54) ROTATIONAL WIRE TRANSPORT FOR AUTOMATED WIRE PROCESSING SYSTEM AND METHODS

(71) Applicant: The Boeing Company, Chicago, IL (US)

(72) Inventor: John Porter, Edgewood, WA (US)

(73) Assignee: The Boeing Company, Chicago, IL (US)

( * ) Notice: Subject to any disclaimer, the term of this patent is extended or adjusted under 35 U.S.C. 154(b) by 59 days.

(21) Appl. No.: 15/351,273

(22) Filed: Nov. 14, 2016

(65) Prior Publication Data

US 2018/0134514 A1 May 17, 2018

(51) Int. Cl.

| | |
|---|---|
| ***B65H 65/00*** | (2006.01) |
| ***B65H 75/24*** | (2006.01) |
| ***B65H 75/28*** | (2006.01) |
| ***B21C 47/30*** | (2006.01) |
| ***B21C 47/32*** | (2006.01) |

(Continued)

(52) U.S. Cl.

CPC ..... *B65H 65/00* (2013.01); *B21C 47/30* (2013.01); *B65H 54/58* (2013.01); *B65H 75/246* (2013.01); *B65H 75/248* (2013.01); *B65H 75/28* (2013.01); *H01B 13/00* (2013.01); *B21C 47/32* (2013.01); *B65H 2701/36* (2013.01); *Y10T 29/4949* (2015.01); *Y10T 29/49174* (2015.01); *Y10T 29/514* (2015.01); *Y10T 29/5193* (2015.01)

(58) Field of Classification Search

CPC ..... B21C 47/32; B21C 47/30; B65H 75/246; B65H 75/248; B65H 75/242; B65H 75/247; B65H 75/28; Y10T 29/5136–5145; Y10T 29/5187; Y10T 29/5193; Y10T 29/5199

USPC ..... 242/586.4, 575.3, 580; 29/564–564.8, 29/33 F, 33 M; 140/71 C

See application file for complete search history.

(56) References Cited

U.S. PATENT DOCUMENTS 329,053 A * 10/1885 Kizer et al. ..... B65H 75/246 242/575.3
1,726,279 A * 8/1929 Werner ..... B21C 47/30 242/575.3

(Continued)

FOREIGN PATENT DOCUMENTS

CN 104550580 4/2015
DE 837382 C * 4/1952

(Continued)

OTHER PUBLICATIONS

Cheers Electronic Technical Co., LTD, "best striping and wirecutting machine CSC-515F2", Aug. 18, 2016, 4 pages [online], [retrieved on Feb. 6, 2017]. Retrieved from the Internet: <URL:http://www.wirecuttermachine.com/Others/best-striping-and-wirecutting-machine-CSC-515F2.htm>.

(Continued)

*Primary Examiner* — Erica E Cadugan
(74) *Attorney, Agent, or Firm* — Haynes and Boone, LLP

(57) ABSTRACT

Systems and methods are provided for a rotational wire transport. In certain examples, the rotational wire transport may be a part of a wire processing system. The rotational wire transport may include a winding spool, a linear actuator, a cam, and a gripping tab. The rotational wire transport may be configured to wind wire into a coil and move between a plurality of different stations within the wire processing system.

18 Claims, 7 Drawing Sheets

(51) Int. Cl.
*H01B 13/00* (2006.01)
*B65H 54/58* (2006.01)

(56) References Cited

U.S. PATENT DOCUMENTS

| | | | | | |
|---|---|---|---|---|---|
| 2,943,807 | A * | 7/1960 | Loop | B21C 47/28 | 242/573.4 |
| 3,214,114 | A * | 10/1965 | Wilson | B21C 47/32 | 242/125.1 |
| 4,370,786 | A | 2/1983 | Butler | | |
| 5,603,469 | A * | 2/1997 | Stocchi | B65H 75/28 | 24/499 |
| 5,813,658 | A | 9/1998 | Kaminski et al. | | |
| 6,533,205 | B1 * | 3/2003 | Kles | B65H 54/58 | 242/362 |
| 7,740,199 | B2 * | 6/2010 | Aikoh | B65H 75/28 | 242/125.2 |
| 2013/0056110 | A1 * | 3/2013 | Yamaguchi | H01F 41/064 | 140/71 C |
| 2016/0090247 | A1 | 3/2016 | Mitchell et al. | | |
| 2018/0174712 | A1 * | 6/2018 | Porter | H01R 43/28 | |
| 2018/0174714 | A1 * | 6/2018 | Porter | H01R 43/0263 | |
| 2018/0174715 | A1 * | 6/2018 | Porter | H01B 13/01236 | |

FOREIGN PATENT DOCUMENTS

| | | | |
|---|---|---|---|
| DE | 1173760 | B * | 7/1964 |
| DE | 3934401 | | 4/1991 |
| DE | 4021744 | A1 * | 1/1992 |
| DE | 102017125039 | B3 * | 8/2018 |
| EP | 3021430 | | 5/2016 |
| GB | 2049500 | | 12/1980 |
| JP | 62/137816 | | 6/1987 |
| JP | 06-127842 | A * | 5/1994 |
| JP | 2004220977 | | 8/2004 |
| JP | 2014235908 | | 12/2014 |
| WO | WO 2004/021368 | | 3/2004 |

OTHER PUBLICATIONS

Cheers Electronic Technical Co., LTD: "Wire Cutting Stripping Machine CSC-508SD", Aug. 22, 2016, 5 pages [online], [retrieved on Feb. 6, 2017]. Retrieved from the Internet: <URL:http://www.wirecuttermachine.com/Cable-Wire-Cut-Strip/Wire-Cutting-Stripping-Machine-CSC508SD.html>.

Ingrid West Machinery Ltd, "Compact 300MM Wide Foil Winding Machine Series for LV Transformers", Oct. 23, 2016, 3 pages [online], [retrieved on Feb. 6, 2017]. Retrieved from the Internet: <URL:http://www.coilwindingmachines.eu/heavy_duty_winding_machines/compact_foil_winding_machine.html>.

Ingrid West Machinery Ltd, "Enamel Wire Strippers—Abrasive Wheel Version", Oct. 23, 2016, 2 pages [online], [retrieved on Feb. 6, 2017]. Retrieved from the Internet: <URL:http://www.coilwindingmachines.eu/production_aids/s02_stone_style_wire_stripper.html>.

Ingrid West Machinery Ltd, "Expandable Winding Mandrels", Oct. 23, 2016, 5 pages [online], [retrieved on Feb. 6, 2016]. Retrieved from the Internet: <URL:http://www.coilwindingmachines.eu/heavy_duty_winding_machines/expanding_mandrel_to_hold_coil_during_winding.html>.

* cited by examiner

ROTATIONAL WIRE TRANSPORT FOR AUTOMATED WIRE PROCESSING SYSTEM AND METHODS

TECHNICAL FIELD

The disclosure relates generally to wire processing and more specifically, for example, to wire processing for wire harnesses used in aircraft.

BACKGROUND

High reliability is often needed for wiring harnesses such as those used in aircraft subsystems. The production process used to fabricate such harnesses are required to be of high standards, including using high quality wires, connections, and connectors and assembling them in a repeatable manner that minimizes failure. Such high standards have traditionally rendered automated wire assembly systems impractical for fabricating aircraft wiring harnesses.

SUMMARY

Systems and methods are disclosed herein for wire processing. In certain examples, a rotational wire transport may be disclosed and may include a winding spool including a first spool surface and a spool body protruding from the first spool surface and configured to rotate around a first axis, a linear actuator coupled to the spool body and configured to move between at least a retracted position and an extended position, a cam coupled to the linear actuator, and configured to receive a user input to rotate between an engaged position and a disengaged position, where the engaged position is configured to move the linear actuator to the extended position and the disengaged position is configured to move the linear actuator to the retracted position, and a gripping tab disposed on the first spool surface, comprising a gripping surface, and configured to move between an open position and a closed position, where the closed position is configured to grip a wire between the gripping surface and the first spool surface.

In certain other examples, a method may be disclosed and may include moving a gripping tab to an open position, engaging a cam coupled to a winding spool, providing wire to the winding spool, moving the gripping tab to a closed position, rotating the winding spool around a first axis, disengaging the cam, and moving the gripping tab to the open position.

In certain additional examples, another method may be disclosed and may include disposing a linear actuator within a spool cavity of a winding spool, wherein the linear actuator is configured to move between at least a retracted position and an extended position, disposing a cam within a body cavity of the winding spool, wherein the cam is configured to receive a user input to rotate between an engaged position and a disengaged position, wherein the engaged position is configured to move the linear actuator to the extended position and the disengaged position is configured to move the linear actuator to the retracted position, and coupling a gripping tab to a first spool surface of the winding spool, wherein the gripping tab is comprised of a gripping surface, and is configured to move between an open position and a closed position, wherein the closed position is configured to grip a wire between the gripping surface and the first spool surface.

The scope of the invention is defined by the claims, which are incorporated into this section by reference. A more complete understanding of the disclosure will be afforded to those skilled in the art, as well as a realization of additional advantages thereof, by a consideration of the following detailed description of one or more implementations. Reference will be made to the appended sheets of drawings that will first be described briefly.

BRIEF DESCRIPTION OF THE DRAWINGS

Examples of the disclosure and their advantages are best understood by referring to the detailed description that follows. It should be appreciated that like reference numerals are used to identify like elements illustrated in one or more of the figures.

DETAILED DESCRIPTION

Systems and techniques for wire processing are described in the disclosure herein in accordance with one or more examples. The wire processing system may include a plurality of processing stations and a rotational wire transport configured to move between the plurality of processing stations. The rotational wire transport may include a winding spool, a linear actuator, a cam, and a gripping tab. In various examples, the winding spool may be configured to rotate around a first axis, the linear actuator may be configured to move between at least a retracted position and an extended position, the cam may be configured to move between an engaged position and a disengaged position, and the gripping tab may include a gripping surface and may be configured to move between an open position and a closed position.

Figure 1:
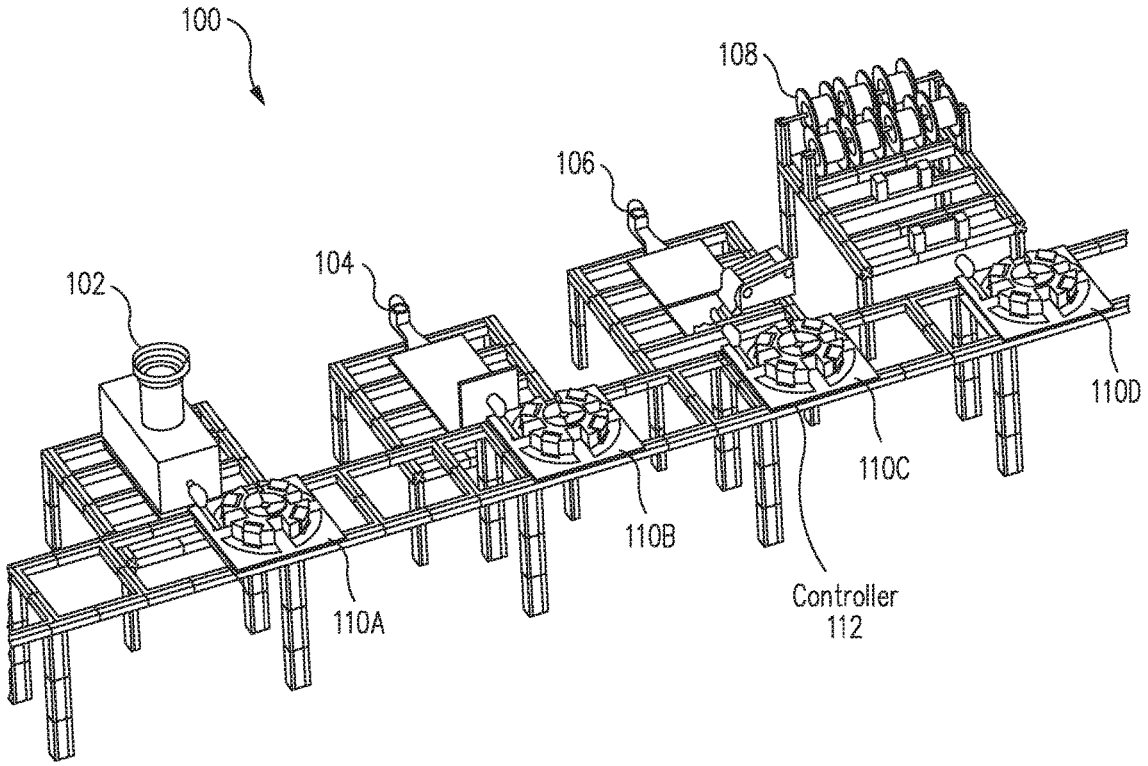
FIG. 1 illustrates a perspective view of a wire processing system in accordance with an example of the disclosure.

FIG. 1 illustrates a perspective view of a wire processing system in accordance with an example of the disclosure. Wire processing system 100 includes a first station 102, a second station 104, a third station 106, a fourth station 108, and rotational wire transports 110A-D.

Stations 102-108 may be one or more different types of wire processing stations. For example, such stations may provide wire to the rotational wire transports, cut wires, strip wires, slice wires, solder wires, attach one or more components (e.g., solder sleeves, connectors, PCB boards, and/or other such components) to the wires, and/or perform other wire processing and/or manufacturing steps. In certain such examples, the rotational wire transports 110A-D may receive wire at one station and move to another station for further processing.

In an illustrative example, station 102 may be a station that may provide a wire to the rotational wire transports. The wire provided may be coiled around the rotational wire transport (e.g., around the winding coil). At least a portion of the wire provided may, after the providing of the wire has finished, be held within a wire receiver of the rotational wire transport.

The rotational wire transport may then move to station 104. Station 104 may, for example, receive the rotational wire transport and position the wire of the rotational wire transport in an orientation to receive a solder sleeve, and then provide the solder sleeve to the wire. In certain examples, the solder sleeve may be provided by, for example, a mechanism that may insert and/or move the solder sleeve on the wire. The rotational wire transport may also include features (such as bottoming features) that may stop the solder sleeve at a certain position so that the solder sleeve is consistently within a fixed area along the length of the wire.

The rotational wire transport may then move to station 106. Station 106 may be configured to receive the wire and cut the wire and/or strip a portion of the wire (e.g., a portion of the insulation and/or shielding). Station 106 may, in certain examples, include mechanisms that may bottom against one or more features of the rotational wire transport (e.g., the wire receiver) and may, from such bottoming features, then determine the area of the wire to be stripped. As such, in certain such examples, a portion of the station 106 may bottom against the feature, position itself against the bottoming feature to determine the portion of the wire to be cut, cut the wire, and strip the wire according to the position of the wire relative to the bottoming feature.

The rotational wire transport may then move to station 108. Station 108 may position the solder sleeve on the wire. In certain examples, station 108 may, for example, move the position of the solder sleeve so that at least a portion of the solder sleeve is positioned over a portion of the stripped portion of the wire.

In certain other examples, other stations may, alternatively or additionally, perform other actions (e.g., couple one or more connectors to the wire, couple the wire to one or more other wires to form a harness, solder the wire to another wire or other electrical component, affix one or more identifying components such as stickers, and/or perform other such actions). Also, other examples may position one or more stations 102-108 in orders different from that described herein. Certain such examples may include fewer and/or additional stations.

In certain examples, one or more controllers (e.g., controller 112) may provide instructions for operation of the wire processing system 100 and/or one or more systems and/or subsystems thereof. The controller 112 may include, for example, a single-core or multi-core processor or microprocessor, a microcontroller, a logic device, a signal processing device, memory for storing executable instructions (e.g., software, firmware, or other instructions), and/or any elements to perform any of the various operations described herein. In various examples, the controller 112 and/or its associated operations may be implemented as a single device or multiple devices (e.g., communicatively linked through analog, wired, or wireless connections such as through one or more communication channels) to collectively constitute the controller 112.

The controller 112 may include one or more memory components or devices to store data and information. The memory may include volatile and non-volatile memory. Examples of such memories include RAM (Random Access Memory), ROM (Read-Only Memory), EEPROM (Electrically-Erasable Read-Only Memory), flash memory, or other types of memory. In certain examples, the controller 112 may be adapted to execute instructions stored within the memory to perform various methods and processes described herein.

Figure 2:
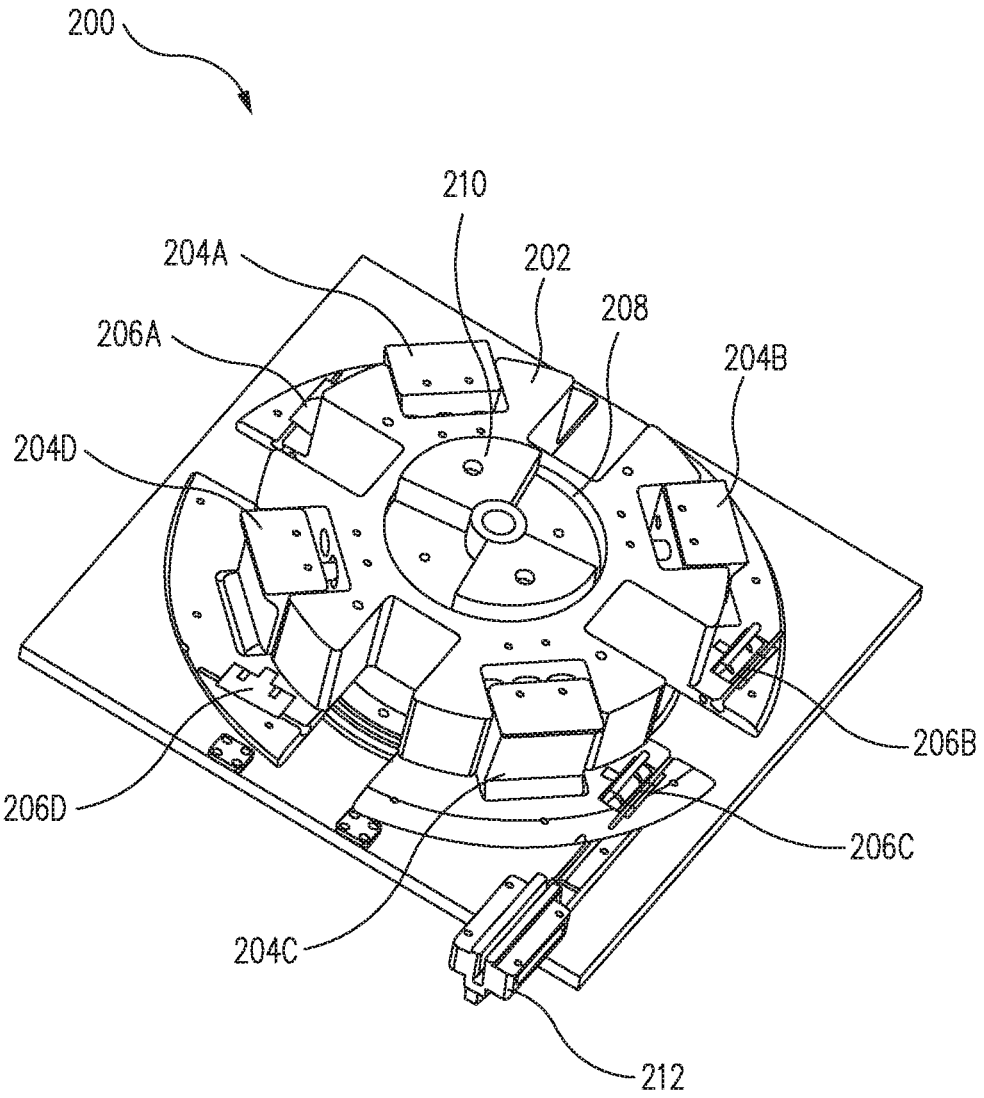
FIG. 2 illustrates a perspective view of a rotational wire transport in accordance with an example of the disclosure.

FIG. 2 illustrates a perspective view of a rotational wire transport in accordance with an example of the disclosure. Rotational wire transport 200 illustrated in FIG. 2 may include a winding spool 202, linear actuators 204A-D, gripping tabs 206A-D, a body cavity 208, a cam 210, and a wire receiver 212.

The winding spool 202 may be configured to rotate around a first axis. In certain examples, the winding spool 202 may be cylindrical and/or substantially cylindrical. In other examples, the winding spool 202 may be any shape (e.g., convex shapes, concave shapes, oval, triangular, square, pentagonal, hexagonal, octagonal, and/or other such shapes) that may be able to receive wire from a wire source and rotate to wind wire around the winding spool 202. In certain examples, the winding spool 202 may additionally include features (e.g., ridges, grooves, tapers, and/or other such features) that aid in receiving, holding, and/or winding wire around the winding spool 202. In the example shown in FIG. 2, the winding spool 202 may include a substantially cylindrical central spool that may be configured to receive wire and wind the wire around the spool and a surface that may include gripping tabs and/or other components.

Linear actuators 204A-D may be disposed in one or more cavities of the winding spool 202 and/or other component of the rotational wire transport 200. Linear actuators 204A-D may move between at least a retracted position and an extended position. If one or more linear actuators 204A-D are in the extended position, the one or more extended linear actuators 204A-D may be in a position farther from a surface of the winding spool 202 than in the retracted position. The linear actuators 204A-D may, for example, be configured to move to the extended position to preload a wire coiled around the winding spool 202 (e.g., hold the wire against the winding spool 202 so that, for example, the wire does not slip or fall off). The linear actuators 204A-D may move between the extended and retracted positions. In certain examples, the linear actuators 204A-D may move between the extended and retracted positions according to movement of the cam 210. For example, the cam 210 may be rotatable so that, in one position, a lower base surface of the cam may contact one or more surfaces of the linear actuators 204A-D (e.g., a side of the linear actuators 204A-D different from the side configured to contact the wires, one or more bearings and/or other rollers coupled to the linear actuators 204A-D, one or more sliding surfaces of the linear actuators 204A-D, and/or other such components and/or surfaces of the linear actuators 204A-D). The cam 210 may then be rotated to a second position so that a higher lobe surface of the cam may contact the one or more surfaces of the linear actuators 204A-D and move the linear actuators 204A-D from the retracted position to the extended position.

If one or more linear actuators 204A-D are in the retracted position, the one or more retracted linear actuators 204A-D may be flush with a surface of the winding spool 202, may be retracted into a cavity of the winding spool 202, and/or may be otherwise in a position closer to a surface of the winding spool 202 than in the extended position. In certain other examples, the linear actuators 204A-D may be configured to move to additional positions different from the retracted and extended positions. Such examples may include, for example, intermediate positions (e.g., positions between the retracted and extended positions) that the linear actuators 204A-D may also be configured to move to.

The body cavity 208 may be, for example, a cavity within the winding spool 202 that may be configured to receive the cam 210. In various examples, the body cavity 208 may be disposed within or close to a center of the winding spool 202. For example, at least a portion of the body cavity 208 may pass through an axis that the winding spool 202 is configured to rotate around.

The cam 210 may be disposed within the body cavity 208. The cam 210 may include, for example, at least the lower base surface and the higher lobe surface. In certain examples, the transition between the base surface and the higher lobe surface may be smooth. That is, the base surface and the higher lobe may be connected by a surface that allows a surface and/or bearing to smoothly roll between the base surface and the higher lobe. In certain examples, the cam 210 may also include intermediate positions (e.g., depressions that may allow a roller coupled to the linear actuators 204A-D to rest within the depression) so that the linear actuators may be configured to move between the intermediate positions and/or the extended and retracted positions.

The gripping tabs 206A-D may be tabs that may guide and/or hold wires that may be wound the winding spool 202. Though reference is made herein to "gripping tabs 206A-D" and/or other components that the rotational wire transport 200 may include a plurality of, as discussed herein, such references may be used to refer to such components in both the singular and plural manner. As such, for example, when a feature of the "gripping tabs 206A-D" is described, such a feature may be present in one, some, or all of the gripping tabs 206A-D.

In certain examples, gripping tabs 206A-D may be tabs that may move between, at least, an open position and a closed position. In the closed position, the gripping tabs 206A-D may be configured to grip a wire. In certain such examples, the gripping tabs 206A-D may include, for example, gripping surfaces. Certain such examples may include a gripping surface on the gripping tabs 206A-D (e.g., a portion of the gripping tabs 206A-D that may be moved) and corresponding surfaces on the winding spool 202. In certain additional examples, the winding spool 202 may not include corresponding surfaces on the winding spool 202. Instead, the gripping tabs may hold the wire against the normal surface of the winding spool 202 (e.g., the surface without any additional inserts such as rubber pads) and/or another such surface on the rotational wire transport 200.

In certain examples, the gripping tabs 206A-D may be spring loaded. As such, the springs may be configured to apply a force so that the gripping tabs 206A-D are normally in the closed position. If a force above a threshold force is applied to the gripping tabs 206A-D, the gripping tabs 206A-D may be moved to the open position.

Wire receiver 212 may be configured to receive and/or hold wire. In certain examples, the wire receiver 212 may position the wire so that the wire may be in a position to be provided to the winding spool 202. As such, for example, the wire may be positioned and/or held in a position that is substantially tangent to a surface of the winding spool 202. The wire receiver 212 may also include features that may receive (e.g., lead-ins) and/or hold the wire within the wire receiver 212 (e.g., features that may allow the wire to be inserted into the wire receiver 212, but once the wire is inserted, may prevent the wire from being pulled out of the wire receiver 212 through the feature).

Figure 3:
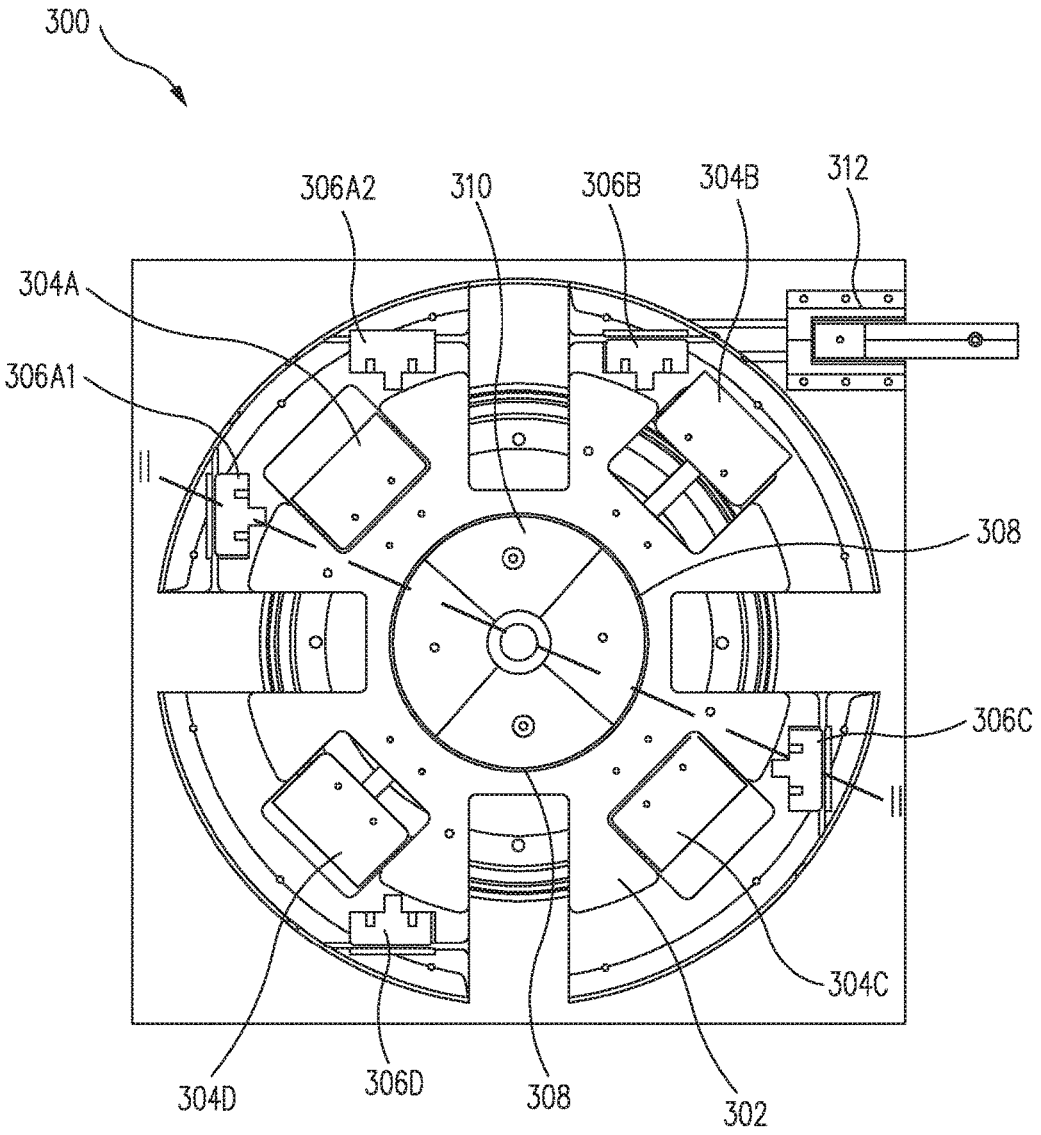
FIG. 3 illustrates a top view of a rotational wire transport in accordance with an example of the disclosure.

FIG. 3 illustrates a top view of a rotational wire transport in accordance with an example of the disclosure. FIG. 3 may illustrate a rotational wire transport 300 that may include a winding spool 302, linear actuators 304A-D, gripping tabs 306A1, 306A2, and 306B-D, a body cavity 308, a cam 310, and a wire receiver 312. The components of the rotational wire transport 300 may be similar to corresponding components of the rotational wire transport 200 illustrated in FIG. 2.

As shown in FIG. 3, the linear actuators 304A and 304C may be in the retracted position. The linear actuators 304B and 304D may be in the extended position. As such, in certain embodiments, one or more of the linear actuators may move independently of movement of one or more of the other linear actuators.

Rotational wire transport 300 may also include one more gripping tab than rotational wire transport 200. (Other embodiments of rotational wire transports may also include more or less components, such as more or less gripping tabs, linear actuators, and/or other components, than the examples of rotational wire transports described herein). Such an additional gripping tab may be used to further hold a wire when the wire is initially provided to the winding spool 302 (e.g., when the wire has not yet been coiled once and/or has only been coiled a limited number of times around the winding spool 302). Accordingly, wire may first be provided to the winding spool 302 through the gripping tabs 306A1 and 306A2, which may be arranged to ensure that the wire is coiled around the winding spool 302.

In certain examples, the linear actuators 304A-D may be in the extended position while the wire is coiled around the winding spool 302. In certain such examples, one or more of the gripping tabs may hold a portion of the wire. After the wire has been coiled around the winding spool 302, the linear actuators 304A-D may be moved to the retracted position and the gripping tabs may be moved to the open position. The wire may then be removed from the winding spool 302 as a coiled bundle.

Figure 4:
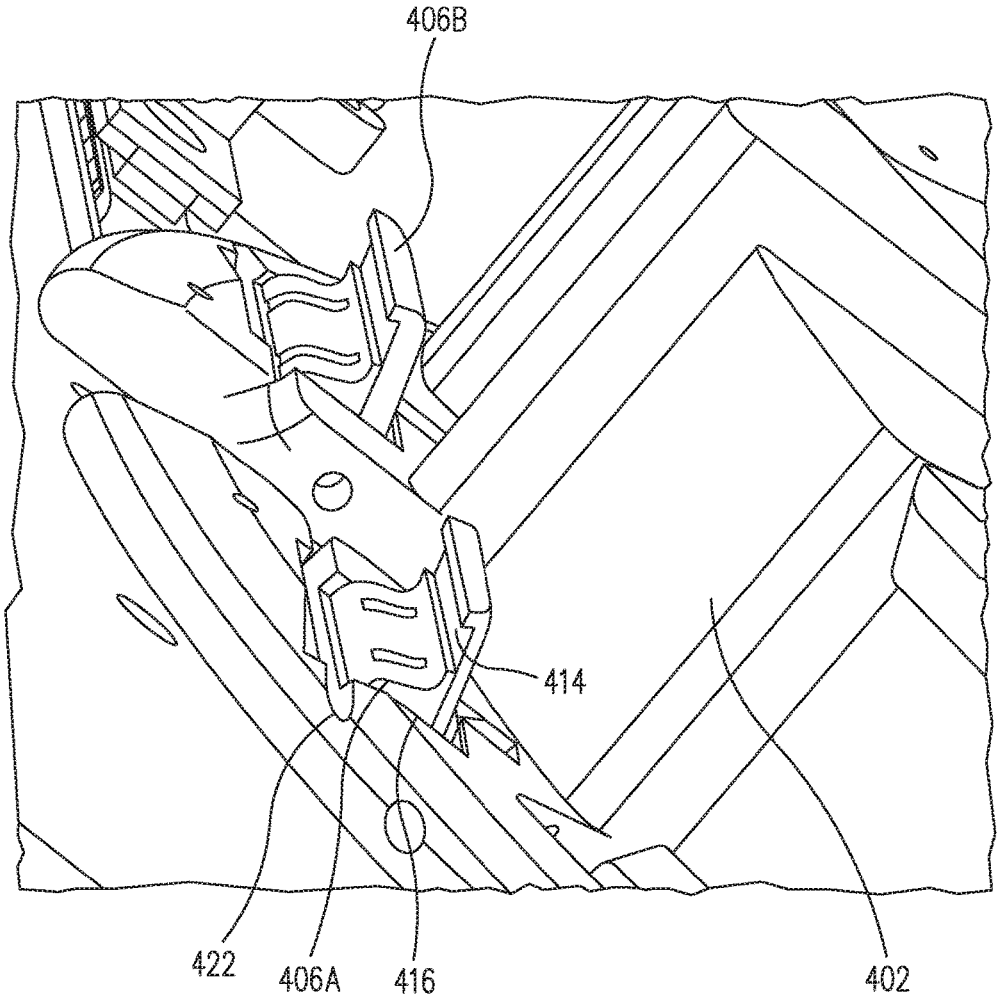
FIG. 4 illustrates a perspective view of the gripping tabs in accordance with an example of the disclosure.

FIG. 4 illustrates a perspective view of the gripping tabs in accordance with an example of the disclosure. FIG. 4 may illustrate gripping tabs 406A and 406B. Gripping tab 406A may include a gripping surface 414 and spring loaded rotational portion 416. Gripping tabs 406A and 406B may be coupled to a portion of a winding spool 402. The winding spool 402 may include a substantially cylindrical central spool that may be configured to receive wire and wind the wire around the spool and a surface that may include gripping tabs and/or other components.

In the example shown in FIG. 4, the gripping surface 414 may include one or more grooves that may be configured to receive the wire and/or hold the wire within the one or more grooves. In other examples, the gripping surface 414 may include, additionally or alternatively, pads and/or other surfaces that may be different in material from that of another portion of the gripping tab and/or other features that may aid in holding and/or gripping the wire.

In the example shown in FIG. 4, the winding spool 402 may include a corresponding groove 422. The groove 422 may also be configured to receive and/or hold the wire. In certain other examples, the winding spool 402 may also include, additionally or alternatively, pads, different materials, and/or features that may aid in holding and/or gripping the wire.

Figure 5:
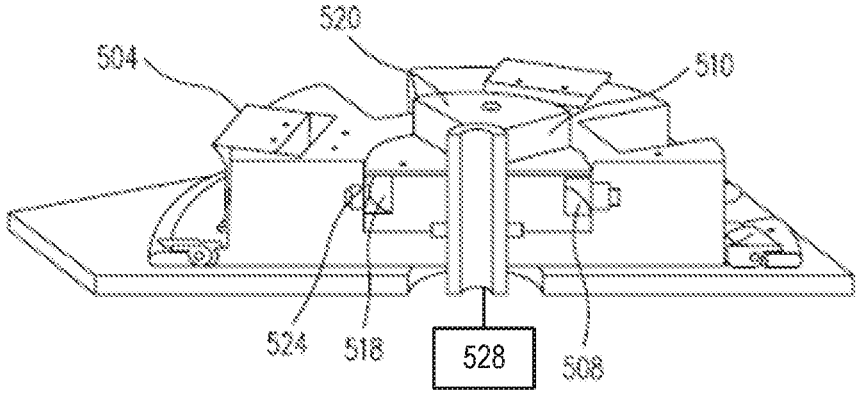
FIG. 5 illustrates a cutaway view of a rotational wire transport such as along line II of FIG. 3 in accordance with an example of the disclosure.

FIG. 5 illustrates a cutaway view of a rotational wire transport such as along line II of FIG. 3 in accordance with an example of the disclosure. FIG. 5 may illustrate a cutaway view of a rotational wire transport with a body cavity 508, and a cam 510 with cam surface 518 and knob portion 520. Additionally, the cutaway view may illustrate linear actuator 504 with a cam interface 524.

The cam 510 may be at least partially disposed within the body cavity 508. In certain examples, the rotational wire transport may include bearings, bushings, rods, and/or other features that may couple one or more components of the rotational wire transport (e.g., the winding spool) to the cam 510 and allow the cam 510 to rotate around a rotational axis. The cam 510 may be moved between an engaged position, a disengaged position, and/or one or more intermediate positions. In the engaged position, the cam 510 may be in a position configured to move one or more linear actuators to the extended position. In the disengaged position, the cam 510 may be in a position configured to the move one or more linear actuators to the retracted position. The one or more intermediate positions may be positions where the cam 510 may be configured to move the one or more linear actuators to positions between the extended and retracted positions.

The cam surface 518 may be, for example, a base surface, a lobe, and/or an intermediate surface of the cam 510. In certain examples, the lobe may be disposed "higher" (e.g., farther from the rotational axis of the cam 510) than the base surface and/or any interface surfaces. The cam surface 518 may be configured to move the linear actuator 504 to a retracted position, an extended position, and/or an intermediate position.

The cam interface 524 may be configured to interface with the cam surface 518. In certain examples, the cam interface 524 may be configured to follow the surfaces of the cam 510. The cam interface 524 may be, for example, a surface (e.g., a back surface different from a surface that may hold the wire), a follower (e.g., a roller), and/or another such surface and/or component of the linear actuator 504 that may follow the cam surface 518 and contribute to moving the linear actuator 504 to the retracted position, the extended position, and/or an interface position.

In certain examples, additional or alternative to the cam interface 524, the cam 510 may be moved by one or more motors 528, as schematically shown in FIG. 5. In such examples, the motor 528 may receive instructions from one or more user interfaces on the rotational wire transport (e.g., one or more buttons and/or touchscreens), remotely, and/or through one or more controllers that may control the wire processing operations.

The knob portion 520 may be a feature and/or surface that may allow a user to interface with the cam 510. The knob portion 520 may a detent, a raised portion, and/or another such feature that may allow a user to turn the cam 510 and, thus, move the linear actuator 504 to the retracted position, the intermediate position, and/or an intermediate position.

Figure 7:
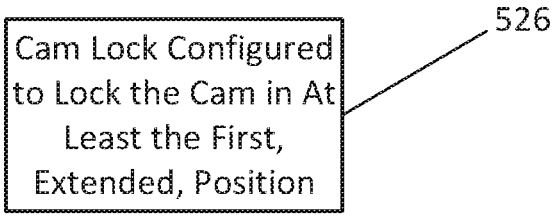
FIG. 7 schematically depicts a feature in accordance with an example of the disclosure.

Additionally, in certain examples, the cam 510 may include a lock 526 as schematically shown in FIG. 7, that may lock the cam 510 in, for example, the engaged position, the disengaged position, an intermediate position, and/or other such positions. The cam 510 may be locked via a locking mechanism. Examples of locking mechanisms include keys, movable mechanisms that may, for example, prevent movement of the cam 510 when the mechanism is moved to at least one position (e.g., rotated, translated, and/or otherwise moved), magnetic locking devices, and/or other such locking mechanisms.

Figure 6:
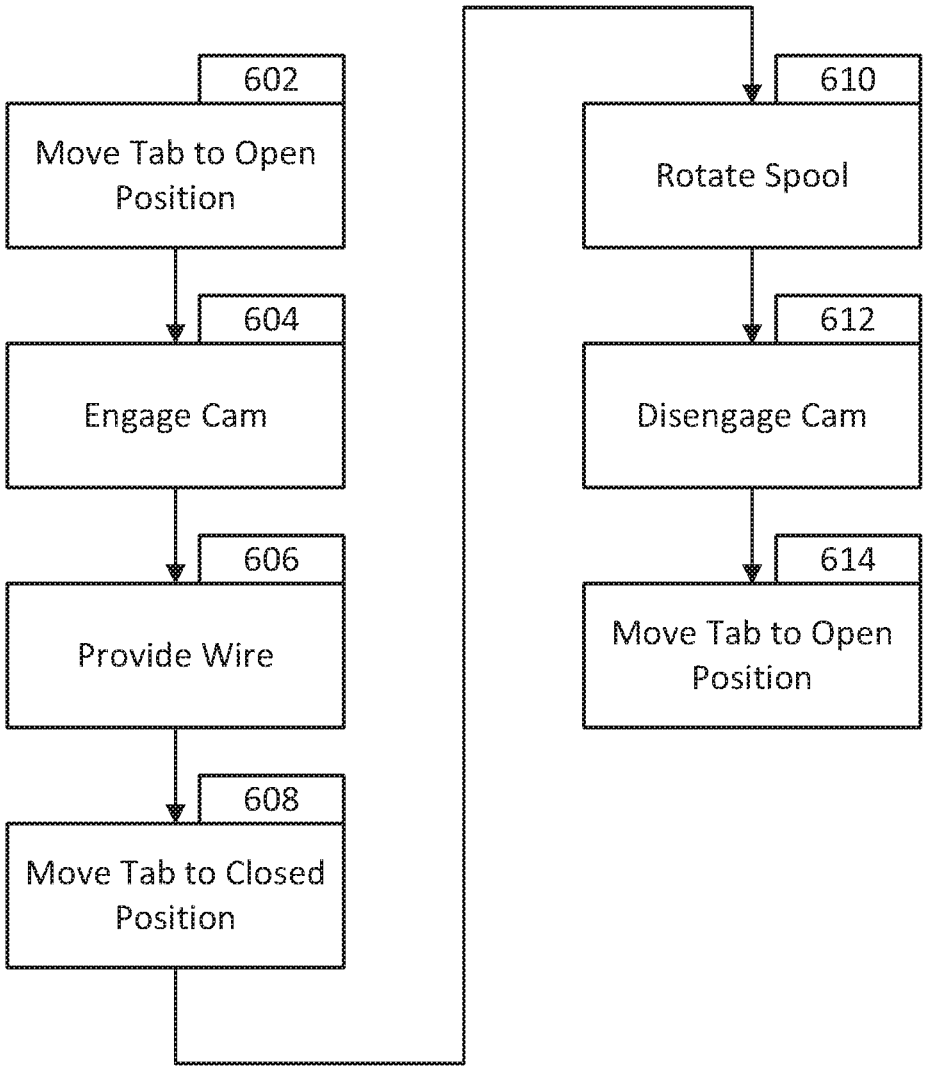
FIG. 6 is a flowchart detailing wire processing using a rotational wire transport in accordance with an example of the disclosure.

FIG. 6 is a flowchart detailing wire processing using a rotational wire transport in accordance with an example of the disclosure. In block 602, one or more gripping tabs may be moved to an open position. As such, the one or more gripping tabs in the open position may be configured to receive one or more wires.

In block 604, the cam may be engaged so that one or more linear actuators of the rotational wire transport are in the extended position. The one or more linear actuators may be moved to the extended position by, for example, turning and/or otherwise engaging the cams to move the one or more linear actuators to the extended position.

In block 606, wire may be provided to the rotational wire transport (e.g., to a winding spool of the rotational wire transport). In certain examples, a wire receiver may receive and/or guide one or more wires provided to the rotational wire transport. The wire receiver may guide the wires such that the wire received by the winding spool of the rotational wire transport may be substantially tangent to a surface of the winding spool.

In block 608, one or more gripping tabs may be moved from the open position to the closed position. Thus, the one or more gripping tabs may grip the one or more wires and, accordingly, position the wires for winding.

In block 610, the winding spool may be rotated. Rotating the winding spool may, accordingly, wind (e.g., coil) wire around the winding spool. In block 612, the cam may be disengaged to move the one or more linear actuators to a retracted position. In certain examples, in block 612, the wire may be coiled (e.g., may be rotated a plurality of rotations) around the winding spool. When the linear actuators are in the extended position, the wire may be held taut against the winding spool. As such, moving the one or more linear actuators to the retracted position may relax the wire. In certain examples, in block 612 and/or before block 612, the wire may be processed (e.g., may be cut, stripped, and/or may have components attached to the wire) at one or more stations. In certain such embodiments, processing the wire may include moving the rotational wire transport to the one or more stations. Additionally, alternatively or additionally, the wire may be processing, before, during, and/or after block 614.

In block 614, the one or more gripping tabs may be moved to the open position. Moving the one or more gripping tabs to the open position may allow the wire and/or a wire coil to be removed from the winding spool.

Examples described above illustrate but do not limit the invention. It should also be understood that numerous modifications and variations are possible in accordance with the principles of the present invention. Accordingly, the scope of the invention is defined only by the following claims.

What is claimed is:

1. An apparatus comprising:

a winding spool configured to rotate and comprising a first spool surface and a spool body protruding from the first spool surface, wherein the spool body comprises a second spool surface disposed at an angle to the first spool surface;

a linear actuator member coupled to the spool body, the linear actuator member comprising a first end and a second end, the first end comprising an outer surface, wherein the linear actuator member is configured to move between at least a retracted position and an extended position, and wherein the outer surface extends farther away from the second spool surface when the linear actuator member is in the extended position than when the linear actuator member is in the retracted position;

a cam coupled to the linear actuator member, the cam comprising a lobe surface and a base surface, and configured to receive a user input to rotate between a first position and a second position, wherein the lobe surface is configured to contact the second end of the linear actuator member, when the cam is in the first position, to move the linear actuator member to the extended position, and wherein the base surface is configured to contact the second end of the linear actuator member, when the cam is in the second position, to move the linear actuator member to the retracted position; and a gripping tab disposed on the first spool surface, the gripping tab comprising a gripping surface, and the gripping tab being configured to move between an open position and a closed position, wherein when the gripping tab is in the closed position, the gripping surface is disposed proximate the first spool surface such that the gripping surface and the first spool surface grip a wire therebetween.

2. The apparatus of claim 1, wherein the gripping tab is a first gripping tab and further comprising a second gripping tab configured to move independent of the first gripping tab.

3. The apparatus of claim 1, wherein the gripping tab is spring loaded.

4. The apparatus of claim 1, wherein the spool body further comprises a body cavity and the cam is disposed within the body cavity.

5. The apparatus of claim 1, wherein the outer surface is configured to contact a wire.

6. The apparatus of claim 1, further comprising a cam lock configured to lock the cam in at least the first position.

7. The apparatus of claim 1, wherein the spool body is substantially cylindrical.

8. The apparatus of claim 1, wherein the linear actuator member is a first linear actuator member, and the apparatus further comprises a second linear actuator member, wherein the cam is coupled to each of the first and second linear actuator members to move each of the first and second linear actuator members to an extended position, and to move each of the first and second linear actuator members to a retracted position.

9. The apparatus of claim 1, wherein the spool body comprises a spool cavity and the linear actuator member is at least partially disposed within the spool cavity.

10. The apparatus of claim 1, wherein a groove that is configured to receive and/or hold the wire is provided in the second spool surface.

11. The apparatus of claim 1, further comprising a wire feeder configured to provide a wire to the winding spool.

12. The apparatus of claim 1, further comprising a motor configured to move the cam.

13. The apparatus of claim 1, further comprising a wire insulation cutter configured to cut insulation of the wire, and/or a connector insertor configured to attach a connector onto an end of the wire.

14. A method of using the apparatus of claim 1, comprising:

moving the gripping tab to the open position;
moving the cam to the first position;
providing the wire to the winding spool;
moving the gripping tab to the closed position;
rotating the winding spool;
moving the cam to the second position; and
moving the gripping tab to the open position.

15. The method of claim 14, further comprising:

locking the cam in the first position after moving the cam to the first position.

16. The method of claim 14, further comprising:

cutting the wire after moving the cam to the second position; and
cutting insulation of the wire after the cutting of the wire.

17. A method of assembling the apparatus of claim 1, comprising:

disposing the linear actuator member within a spool cavity of the winding spool;
disposing the cam within a body cavity of the winding spool; and
coupling the gripping tab to the first spool surface of the winding spool.

18. The method of claim 17, further comprising:

coupling the cam to a motor configured to move the cam.

* * * * *